US011094310B2

(12) United States Patent
Toh et al.

(10) Patent No.: US 11,094,310 B2
(45) Date of Patent: Aug. 17, 2021

(54) SIGNAL PROCESSOR, NOISE CANCELING SYSTEM, SIGNAL PROCESSING METHOD, AND PROGRAM

(71) Applicant: PANASONIC INTELLECTUAL PROPERTY MANAGEMENT CO., LTD., Osaka (JP)

(72) Inventors: Daichi Toh, Osaka (JP); Wakio Yamada, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 5 days.

(21) Appl. No.: 16/642,839

(22) PCT Filed: Aug. 20, 2018

(86) PCT No.: PCT/JP2018/030700
§ 371 (c)(1),
(2) Date: Feb. 27, 2020

(87) PCT Pub. No.: WO2019/044564
PCT Pub. Date: Mar. 7, 2019

(65) Prior Publication Data

US 2020/0349917 A1 Nov. 5, 2020

(30) Foreign Application Priority Data

Aug. 29, 2017 (JP) ..... JP2017-164775

(51) Int. Cl.
*G10K 11/178* (2006.01)
*G10L 21/0232* (2013.01)
*G10K 11/175* (2006.01)

(52) U.S. Cl.
CPC ..... *G10K 11/17825* (2018.01); *G10K 11/175* (2013.01); *G10K 11/17879* (2018.01); *G10L 21/0232* (2013.01)

(58) Field of Classification Search
CPC ..... G10K 11/175; G10K 11/1752; G10K 11/17825; G10K 11/17879;
(Continued)

(56) References Cited

U.S. PATENT DOCUMENTS 5,278,780 A * 1/1994 Eguchi ..... G10K 11/178 708/322
5,995,632 A * 11/1999 Okada ..... F04D 29/663 381/71.3
(Continued)

FOREIGN PATENT DOCUMENTS

JP H03-273798 A 12/1991
JP 2006-308809 A 11/2006
(Continued)

OTHER PUBLICATIONS

International Search Report and Written Opinion issued in International Patent Application No. PCT/JP2018/030700, dated Oct. 16, 2018; with partial English translation.

*Primary Examiner* — Kile O Blair
(74) *Attorney, Agent, or Firm* — McDermott Will and Emery LLP

(57) ABSTRACT

According to the present disclosure, an additional sound generating unit detects, as a noise frequency, a frequency of a noise at a control point and generates an additional sound signal including signal components with additional frequencies different from the noise frequency. A canceling signal generating unit generates a canceling signal that cancels the noise at the control point. An emission unit outputs a control sound signal, generated by adding the additional sound
(Continued)

signal to the canceling signal, to a loudspeaker and makes the loudspeaker emit the control sound.

14 Claims, 6 Drawing Sheets

(58) Field of Classification Search
CPC ..... G10K 11/17883; G10K 11/17881; G10K 2210/121; G10K 2210/3037
See application file for complete search history.

(56) References Cited

U.S. PATENT DOCUMENTS

| | | | | |
|---|---|---|---|---|
| 10,714,069 | B1 * | 7/2020 | Ratner | G10K 15/02 |
| 2008/0118083 | A1 | 5/2008 | Mitsuhata | |
| 2020/0335077 | A1 * | 10/2020 | Ratner | G10F 1/00 |

FOREIGN PATENT DOCUMENTS

| | | | |
|---|---|---|---|
| JP | 2008-233670 | A | 10/2008 |
| JP | 2012-037577 | A | 2/2012 |

* cited by examiner

SIGNAL PROCESSOR, NOISE CANCELING SYSTEM, SIGNAL PROCESSING METHOD, AND PROGRAM

CROSS-REFERENCE OF RELATED APPLICATIONS

This application is the U.S. National Phase under 35 U.S.C. § 371 of International Patent Application No. PCT/JP2018/030700, filed on Aug. 20, 2018, which in turn claims the benefit of Japanese Application No. 2017-164775, filed on Aug. 29, 2017, the entire disclosures of which Applications are incorporated by reference herein.

TECHNICAL FIELD

The present disclosure generally relates to a signal processor, a noise canceling system, a signal processing method, and a program.

BACKGROUND ART

An active noise control system using an active noise control technique has been known in the art as a system for reducing a noise produced from a noise source, in a target space where the noise propagates. As used herein, the "active noise control" is a technique for actively reducing noise by emitting a canceling sound having a reverse phase and the same amplitude with respect to the noise.

For example, according to Patent Literature 1, a fundamental wave emitted at a predetermined frequency from a fundamental sound source is multiplied by an adaptive filter coefficient to obtain a signal, on which a noise canceling sound is produced. In addition, to improve the ability to follow the variation in the peak frequency of a periodic noise, if the magnitude of phase change of the noise canceling sound is greater than a predetermined threshold value, then the frequency of the fundamental wave emitted from the fundamental sound source is increased or decreased to a predetermined degree.

However, it is difficult to produce a noise canceling sound that would completely cancel a noise due to the effects of a disturbance noise, an arithmetic error, and a variation in some environmental condition (such as the temperature, humidity, pressure, or any other parameter of the target space). Consequently, a residual component of the noise that has not been canceled by the noise canceling sound is still audible as a residual noise component for the user, thus making him or her feel unpleasant.

CITATION LIST

Patent Literature

Patent Literature 1: JP 2006-308809 A

SUMMARY OF INVENTION

In view of the foregoing background, it is therefore an object of the present disclosure to provide a signal processor, a noise canceling system, a signal processing method, and a program, all of which are configured or designed to actively reduce a noise and decrease the unpleasantness caused to the user by a residual noise component that has not been canceled.

A signal processor according to the present disclosure includes an additional sound generating unit, a canceling signal generating unit, and an emission unit. The additional sound generating unit detects, as a noise frequency, a frequency of a noise produced from a noise source and generates an additional sound signal including a signal component with an additional frequency different from the noise frequency. The canceling signal generating unit generates a canceling signal for canceling the noise at a control point that the noise and a control sound emitted from a sound emitter reach. The emission unit outputs a control sound signal, generated by adding the additional sound signal to the canceling signal, to the sound emitter and makes the sound emitter emit the control sound.

A noise canceling system according to the present disclosure includes: the signal processor described above; a sound collector to convert a sound picked up at the control point into a picked up signal, and output the picked up signal to the signal processor; and a sound emitter to receive the control sound signal and emit the control sound.

A signal processing method according to the present disclosure includes: detecting, as a noise frequency, a frequency of a noise produced from a noise source to generate an additional sound signal including a signal component with an additional frequency different from the noise frequency. The signal processing method further includes generating a canceling signal for canceling the noise at a control point that the noise and a control sound emitted from a sound emitter reach. The signal processing method further includes outputting a control sound signal, generated by adding the additional sound signal to the canceling signal, to the sound emitter to make the sound emitter emit the control sound.

A program according to the present disclosure is designed to make a computer system execute the signal processing method described above.

DESCRIPTION OF EMBODIMENTS

The present disclosure generally relates to a signal processor, a noise canceling system, a signal processing method, and a program, and more particularly relates to a signal processor, a noise canceling system, a signal processing method, and a program, all of which are configured or designed to actively reduce noise.

Exemplary embodiments of the present disclosure will now be described with reference to the accompanying drawings.

Embodiments

Figure 1:
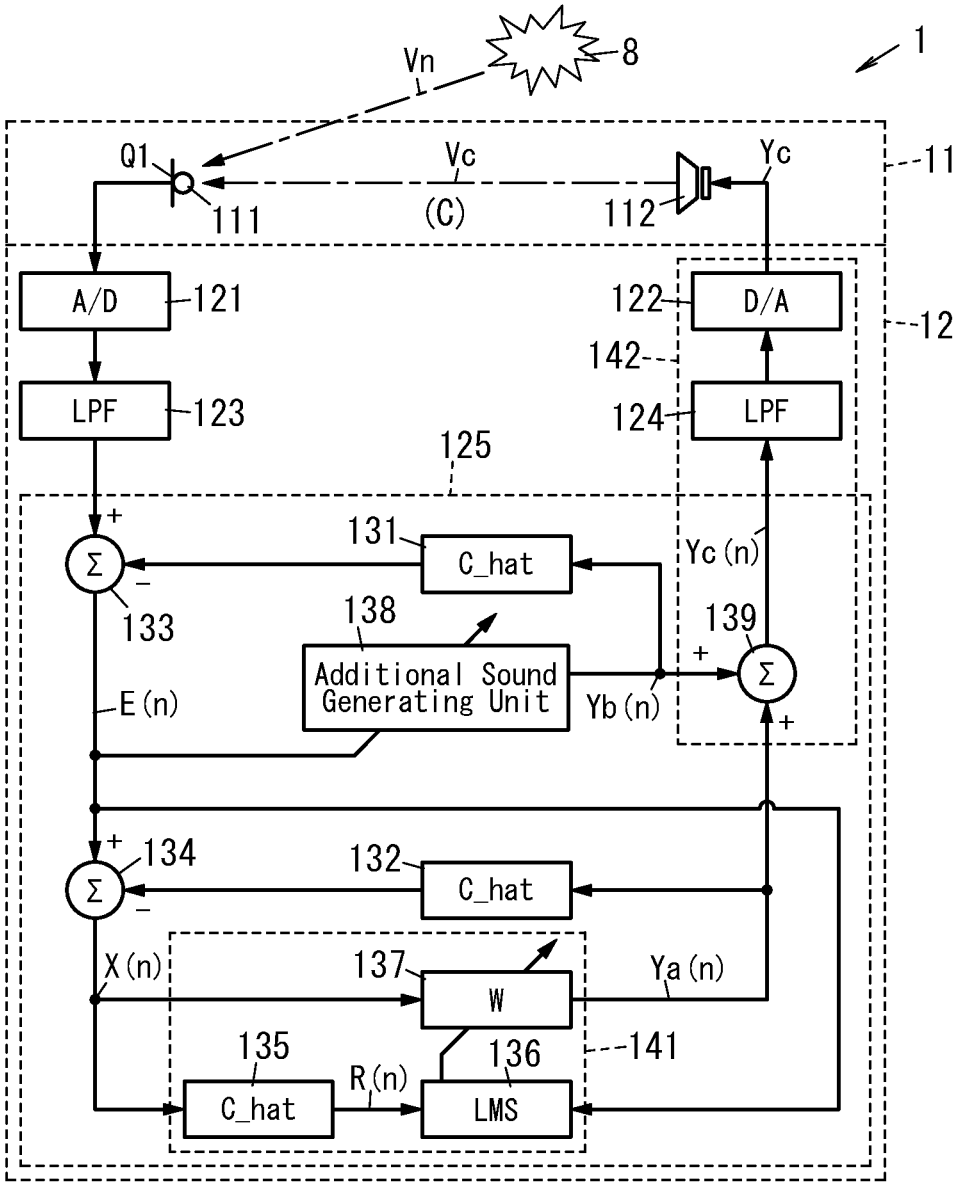
FIG. 1 is a block diagram illustrating a configuration for a noise canceling system according to an exemplary embodiment.

FIG. 1 illustrates a configuration for a noise canceling system 1 according to an exemplary embodiment. The noise canceling system 1 emits a control sound Vc to cancel, in the vicinity of a control point Q1, the noise Vn produced from a noise source 8. The noise source 8 may be, for example, a motor, a compressor, a propeller fan, or a vacuum cleaner, all of which produce a periodic noise. Note that these are only examples of the noise source 8, which may also be any other type of device or even a device that produces a non-periodic noise. In addition, the noise canceling system 1 may be provided separately from, or integrally with, the device to be the noise source 8.

The noise canceling system 1 includes a sound collector-emitter 11 and a signal processor 12.

The sound collector-emitter 11 includes a microphone 111 (working as a sound collector) and a loudspeaker 112 (working as a sound emitter). The loudspeaker 112 emits the control sound Vc. The microphone 111 is located at the control point Q1 and picks up a synthetic sound of the noise Vn and the control sound Vc at the control point Q1 to output an analog picked up signal.

The signal processor 12 includes an A/D converter 121, a D/A converter 122, low-pass filters (LPFs) 123 and 124, and a noise canceling control block 125.

The signal processor 12 according to this embodiment or the agent that performs the signal processing method according to this embodiment includes a computer system. The computer system may include, as principal hardware components, a processor and a memory. The functions of the signal processor 12 according to the present disclosure or the agent that performs the signal processing method according to the present disclosure may be performed by making the processor execute a program stored in the memory of the computer system. The program may be stored in advance in the memory of the computer system. Alternatively, the program may also be downloaded through a telecommunications line or be distributed after having been recorded in some non-transitory storage medium such as a memory card, an optical disc, or a hard disk drive, any of which is readable for the computer system. The processor of the computer system may be made up of a single or a plurality of electronic circuits including a semiconductor integrated circuit (IC) or a largescale integrated circuit (LSI). Those electronic circuits may be either integrated together on a single chip or distributed on multiple chips, whichever is appropriate. Those multiple chips may be integrated together in a single device or distributed in multiple devices without limitation.

The analog picked up signal output from the microphone 111 is A/D converted by the A/D converter 121 into a digital picked up signal, which is then output from the A/D converter 121 to the noise canceling control block 125 via the LPF 123.

The noise canceling control block 125 then outputs a digital control sound signal Yc(n), which is passed through the LPF 124 and then D/A converted by the D/A converter 122 into an analog control sound signal Yc. The loudspeaker 112 receives the analog control sound signal Yc and reproduces and emits the control sound Vc.

The noise canceling control block 125 generates a canceling signal Ya(n) that cancels the noise Vn produced from the noise source 8 so as to decrease the sound pressure level of the noise Vn (residual noise), collected at the control point Q1 where the microphone 111 is set up, to the lowest level. In addition, the noise canceling control block 125 also generates an additional sound signal Yb(n) (to be described later). Then, the noise canceling control block 125 outputs the control sound signal Yc(n) by adding the additional sound signal Yb(n) to the canceling signal Ya(n). On receiving the control sound signal Yc, the loudspeaker 112 reproduces and emits the control sound Vc. The control sound Vc includes a sound represented by the canceling signal Ya(n) (hereinafter referred to as a "canceling sound"). Having the loudspeaker 112 emit the control sound Vc including the canceling sound reduces the noise Vn transmitted from the noise source 8 to the control point Q1.

That is to say, the signal processor 12 (in particular, the noise canceling control block 125) performs active noise control and carries out a noise canceling program that makes the signal processor 12 function as an adaptive filter in order to follow any variation in the noise produced from the noise source 8 or any variation in noise propagation characteristic. The filter coefficient of such an adaptive filter may be updated by, for example, a filtered-X least mean square (LMS) sequentially updated control algorithm.

Next, it will be described in detail how the signal processor 12 operates.

First, the microphone 111 is set up at the control point Q1 to pick up a sound at the control point Q1. The sound at the control point Q1 is a synthetic sound produced by synthesizing together, at the control point Q1, the noise Vn produced from the noise source 8 and the control sound Vc emitted from the loudspeaker 112. That is to say, the microphone 111 picks up the synthetic sound at the control point Q1 and outputs a picked up signal, representing the synthetic sound picked up, to the signal processor 12. The A/D converter 121 A/D converts the picked up signal at a predetermined sampling frequency into digital (discrete) values and outputs the A/D converted digital values to the noise canceling control block 125.

The noise canceling control block 125 includes an additional sound canceling filter 131, a howl canceling filter 132, subtractors 133 and 134, a correction filter 135, a coefficient updating unit 136, a noise control filter 137, an additional sound generating unit 138, and an adder 139. The correction filter 135, the coefficient updating unit 136, and the noise control filter 137 together form a canceling signal generating unit 141. The adder 139, the D/A converter 122, and the LPF 124 together form an emission unit 142.

The additional sound canceling filter 131 is a finite impulse response (FIR) filter, for which a transmission characteristic C_hat simulating the transmission characteristic C of a sound wave from the loudspeaker 112 to the microphone 111 is set as its filter coefficient. Then, the additional sound canceling filter 131 performs a convolution operation on the additional sound signal Yb(n) provided by the additional sound generating unit 138 and the transmission characteristic C_hat and outputs the result of the convolution operation to the subtractor 133.

The subtractor 133 subtracts the output of the additional sound canceling filter 131 from the picked up signal provided by the LPF 123 and outputs a signal representing the remainder thus calculated. That is to say, the control sound Vc includes the sound (additional sound) represented by the additional sound signal Yb(n), and therefore, a signal obtained by subtracting the sneak representing the additional sound from the picked up signal representing the sound picked up by the microphone 111 is output as an error signal E(n) from the subtractor 133. This allows the noise canceling control block 125 to generate the error signal E(n) by removing the sneak representing the additional sound from the picked up signal. The error signal E(n) is input to the subtractor 134, the coefficient updating unit 136, and the additional sound generating unit 138. Note that n is the number of the A/D converted sample.

The howl canceling filter 132 is an FIR filter, for which the transmission characteristic C_hat is set as its filter coefficient. The howl canceling filter 132 performs a convolution operation on the canceling signal Ya(n) provided by the noise control filter 137 and the transmission characteristic C_hat. Then, the subtractor 134 subtracts the output of the howl canceling filter 132 from the error signal E(n) and outputs a signal representing the remainder. That is to say, a signal obtained by subtracting an sneak of the canceling sound from the error signal E(n) is output as a noise signal X(n) from the subtractor 134. This reduces the chances of, even if the canceling sound emitted from the loudspeaker 112 sneaks into the microphone 111, a howl being produced. The noise signal X(n) is input to the correction filter 135 and the noise control filter 137.

Note that the error signal E(n) and the noise signal X(n) both include a signal representing the residual noise component at the control point Q1. As used herein, the "residual noise component" is a component of the noise Vn that has not been removed by the canceling signal at the control point Q1.

The noise control filter 137 is an FIR type adaptive filter, for which a first filter coefficient W(n) is set.

The correction filter 135 is an FIR filter, for which the transmission characteristic C_hat is set as a second filter coefficient. The correction filter 135 performs a convolution operation on the noise signal X(n) provided by the subtractor 134 and the transmission characteristic C_hat (i.e., the second filter coefficient) and outputs the result of the operation as a reference signal R(n) to the coefficient updating unit 136.

The coefficient updating unit 136 updates the first filter coefficient W(n) of the noise control filter 137 by using a known sequentially updated control algorithm called "Filtered-X LMS" in a time domain. In general, in the processing of updating the first filter coefficient W(n) by the Filtered-X LMS, the first filter coefficient W(n) is updated so as to minimize the error signal E(n). That is to say, the coefficient updating unit 136 receives the reference signal R(n) and the error signal E(n) and calculates the first filter coefficient W(n) repeatedly. Then, the coefficient updating unit 136 updates the first filter coefficient W(n) of the noise control filter 137 by sequentially setting the first filter coefficient W(n) that minimizes the error signal E(n) for the noise control filter 137.

Specifically, the processing of calculating the first filter coefficient W(n) is given by the following Equation (1), where μ is an update parameter and n is a sample number. Note that the update parameter μ is also called a "step size parameter," which is a parameter defining the magnitude of correction to be made to the first filter coefficient W(n) in the processing of repeatedly calculating the first filter coefficient W(n) by the LMS algorithm, for example.

$$W(n+1)=W(n)-2\mu R(n)E(n) \quad \text{[Equation 1]}$$

The noise control filter 137 performs a convolution operation on the noise signal X(n) and the first filter coefficient W(n), and outputs the result of the convolution operation as the canceling signal Ya(n). The canceling signal Ya(n) is a signal that makes the loudspeaker 112 emit a canceling sound with the ability to reduce the noise Vn at the control point Q1.

Then, the adder 139 adds the additional sound signal Yb(n) to the canceling signal Ya(n) and outputs the sum as the control sound signal Yc(n).

Next, the additional sound signal Yb(n) and the control sound signal Yc(n) will be described.

In the known art, the canceling signal Ya(n) is D/A converted into an analog signal, which is then supplied to a loudspeaker so that a canceling sound is emitted from the loudspeaker. Nevertheless, some component of the noise Vn often remains uncanceled by the canceling sound and catches the user's ears as a residual noise component that makes him or her feel unpleasant. Thus, to overcome such a problem, according to this embodiment, the control sound signal Yc(n), including the canceling signal Ya(n) and the additional sound signal Yb(n), is D/A converted into an analog signal, which is then supplied to the loudspeaker 112 so that the control sound Vc, including the canceling sound and the additional sound, is emitted from the loudspeaker 112.

First, the additional sound generating unit 138 receives the error signal E(n) and performs frequency analysis processing on the error signal E(n). The frequency analysis processing is carried out to transform, by fast Fourier transform (FFT), the error signal E(n) in the time domain into a signal in the frequency domain, thus detecting, as a noise frequency, a frequency at which the power (spectrum) of the error signal E(n) reaches a local maximum value (hereinafter referred to as a "local maximum frequency"). Note that the additional sound generating unit 138 does not have to detect the noise frequency based on the error signal E(n) but just needs to detect the noise frequency based on a signal representing a picked up sound including the noise.

For example, the additional sound generating unit 138 may detect the local maximum frequency based on a result of comparison between the power at a target frequency (i.e., the frequency to be detected) and the power at a frequency falling within a frequency range surrounding the target frequency, and based on a differential value of the power. In addition, the additional sound generating unit 138 suitably detects, as the noise frequency, just a local maximum frequency caused by a periodic noise, among a plurality of local maximum frequencies. For example, the additional sound generating unit 138 determines a local maximum frequency that has been detected continuously for a certain amount of time as the local maximum frequency caused by the periodic noise. Therefore, a temporarily generated local maximum frequency is not determined to be the noise frequency but only a local maximum frequency caused by the periodic noise is detected as the noise frequency.

In this case, since the error signal E(n) is a signal representing the residual noise component at the control point Q1, the noise frequency corresponds to the frequency of the residual noise component at the control point Q1. That is to say, at the control point Q1, a sound with the noise frequency is audible to the user.

Thus, to decrease the unpleasantness caused by the residual noise component, the additional sound generating unit 138 generates, as the additional sound signal Yb(n), a signal including a signal component with a frequency having a high degree of consonance with respect to the noise frequency. If such a frequency having a high degree of consonance with respect to the noise frequency is called an "additional frequency," then the additional sound signal Yb(n) is a signal including a signal component with the additional frequency. The ratio of the additional frequency to the noise frequency (additional frequency/noise frequency) may be 5/4, 3/2, or 5/3, for example. In this case, a so-called "major six chord" is formed by combining the sound with the noise frequency with respective sound components with the additional frequency, thus producing a sound pleasing to human ears.

Figure 2:
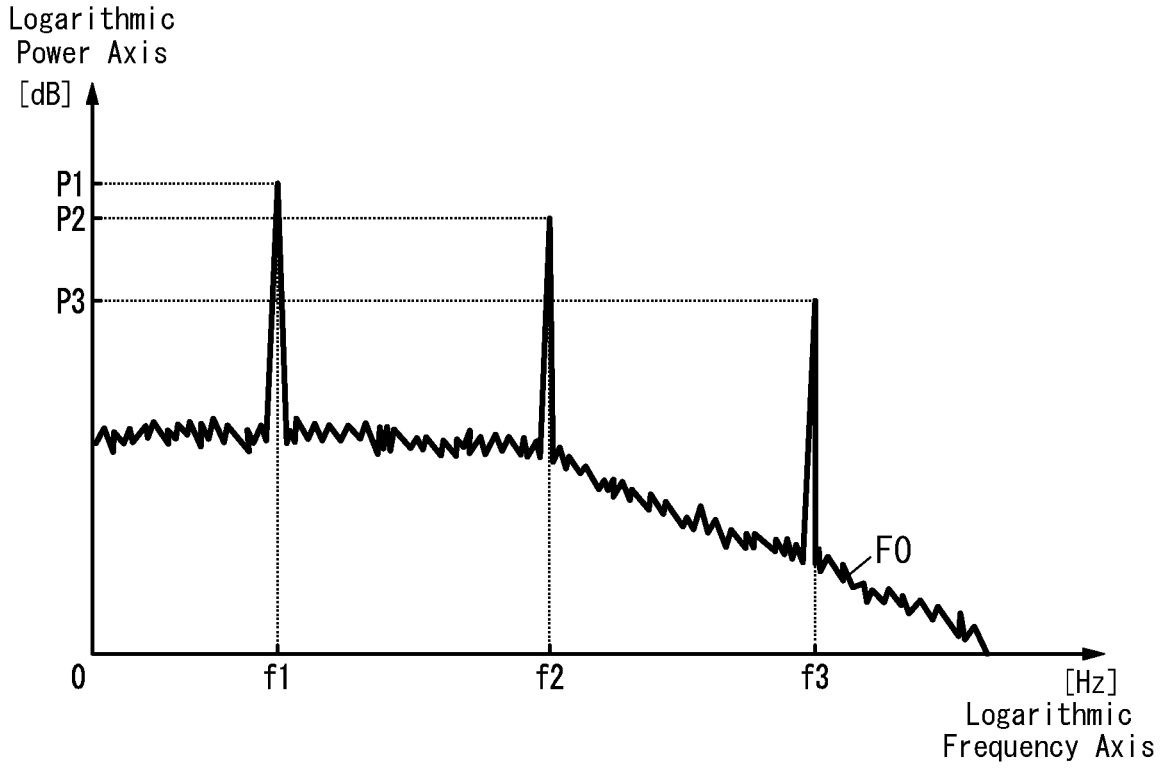
FIG. 2 is a graph showing an exemplary frequency distribution of an error signal of the noise canceling system.

FIG. 2 illustrates an exemplary frequency distribution of the error signal E(n). In FIG. 2, the axis of abscissas is a logarithmic frequency axis (i.e., a frequency axis with a logarithmic scale), the axis of ordinates is a logarithmic power axis (i.e., a power axis with a logarithmic scale), and F0 indicates the frequency distribution of the error signal E(n). The unit of the logarithmic frequency axis is Hz and the unit of the logarithmic power axis is dB. In this case, the power reaches local maximum values at frequencies f1, f2, and f3, and the additional sound generating unit 138 detects the noise frequencies f1, f2, and f3. The powers at the noise frequencies f1, f2, and f3 are P1, P2, and P3, respectively. The noise frequencies f1, f2, and f3 satisfy the inequality f1<f2<f3 and the powers P1, P2, and P3 satisfy the inequality P1>P2>P3. Also, in this embodiment, the frequencies handled by the signal processor 12 of this embodiment fall within the range from approximately 20 to 2,000 Hz. However, this range is only an example and should not be construed as limiting. Alternatively, the range of frequencies may be broader than the range from 20 to 2,000 Hz.

Figure 3:
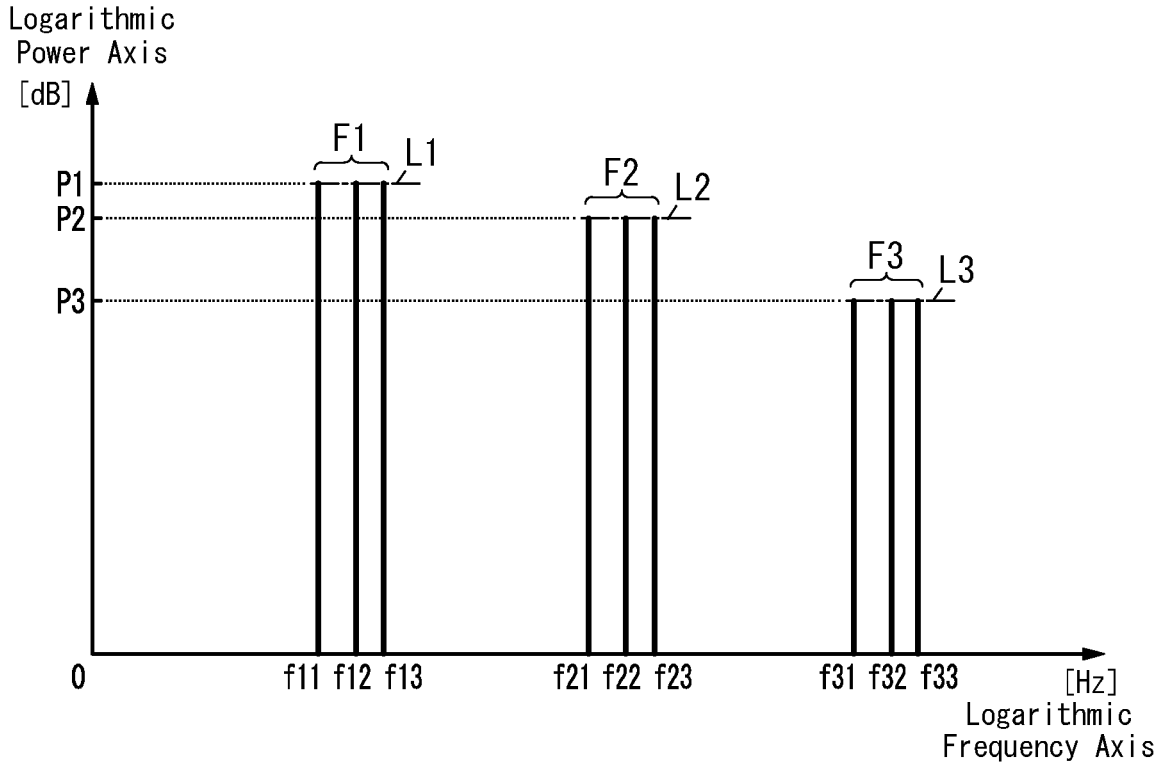
FIG. 3 is a graph showing an exemplary frequency distribution of an additional sound signal of the noise canceling system.

FIG. 3 illustrates an exemplary frequency distribution of the additional sound signal Yb(n). The additional sound generating unit 138 defines frequencies having high degrees of consonance with respect to each of the noise frequencies f1, f2, and f3 as respective additional frequencies.

Specifically, the additional sound generating unit 138 defines additional frequencies with respect to the noise frequency f1 to be frequencies f11, f12, and f13. The additional frequency f11 is calculated by f1×5/4. The additional frequency f12 is calculated by f1×3/2. The additional frequency f13 is calculated by f1×5/3. That is to say, the respective signal components with the additional frequencies f11, f12, and f13 corresponding to the noise frequency f1 (which are represented by the frequency distribution F1 shown in FIG. 3) are included in the additional sound signal Yb(n).

In addition, the additional sound generating unit 138 defines additional frequencies with respect to the noise frequency f2 to be frequencies f21, f22, and f23. The additional frequency f21 is calculated by f2×5/4. The additional frequency f22 is calculated by f2×3/2. The additional frequency f23 is calculated by f2×5/3. That is to say, the respective signal components with the additional frequencies f21, f22, and f23 corresponding to the noise frequency f2 (which are represented by the frequency distribution F2 shown in FIG. 3) are included in the additional sound signal Yb(n).

Furthermore, the additional sound generating unit 138 defines additional frequencies with respect to the noise frequency f3 to be frequencies f31, f32, and f33. The additional frequency f31 is calculated by f3×5/4. The additional frequency f32 is calculated by f3×3/2. The additional frequency f33 is calculated by f3×5/3. That is to say, the respective signal components with the additional frequencies f31, f32, and f33 corresponding to the noise frequency f3 (which are represented by the frequency distribution F3 shown in FIG. 3) are included in the additional sound signal Yb(n).

Furthermore, the additional sound generating unit 138 detects the powers of the error signal E(n) at the noise frequencies f1, f2, and f3. In addition, the additional sound generating unit 138 sets, based on the power P1 at the noise frequency f1, the powers of the respective signal components of the additional sound signal Yb(n) at the additional frequencies f11, f12, and f13, respectively. Likewise, the additional sound generating unit 138 also sets, based on the power P2 at the noise frequency f2, the powers of the respective signal components of the additional sound signal Yb(n) at the additional frequencies f21, f22, and f23, respectively. The additional sound generating unit 138 further sets, based on the power P3 at the noise frequency f3, the powers of the respective signal components of the additional sound signal Yb(n) at the additional frequencies f31, f32, and f33, respectively.

Specifically, the additional sound generating unit 138 adjusts the powers of the respective signal components of the additional sound signal Yb(n) at the additional frequencies f11, f12, and f13 to the power P1 at the noise frequency f1. In addition, the additional sound generating unit 138 also adjusts the powers of the respective signal components of the additional sound signal Yb(n) at the additional frequencies f21, f22 and f23 to the power P2 at the noise frequency f2. Furthermore, the additional sound generating unit 138 further adjusts the powers of the respective signal components of the additional sound signal Yb(n) at the additional frequencies f31, f32 and f33 to the power P3 at the noise frequency f3.

That is to say, the powers of the respective signal components of the additional sound signal Yb(n) at the additional frequencies f11, f12, and f13 come to have values on a virtual line L1 that has a constant gradient with respect to frequencies indicated by the logarithmic axis. In addition, the powers of the respective signal components of the additional sound signal Yb(n) at the additional frequencies f21, f22, and f23 come to have values on a virtual line L2 that has a constant gradient with respect to frequencies indicated by the logarithmic axis. Furthermore, the powers of the respective signal components of the additional sound signal Yb(n) at the additional frequencies f31, f32, and f33 come to have values on a virtual line L3 that has a constant gradient with respect to frequencies indicated by the logarithmic axis. In the example illustrated in FIG. 3, all of the lines L1, L2, and L3 have a gradient of zero, thus facilitating the signal processing by the additional sound generating unit 138.

Then, the additional sound generating unit 138 generates and outputs the additional sound signal Yb(n) having signal components with the additional frequencies f11, f12, and f13, signal components with the additional frequencies f21, f22, and f23, and signal components with the additional frequencies f31, f32, and f33.

Subsequently, the adder 139 adds the additional sound signal Yb(n) to the canceling signal Ya(n) and outputs the sum signal as the control sound signal Yc(n). The control sound signal Yc(n) passes through the LPF 124 and then is D/A converted by the D/A converter 122 into an analog control sound signal Yc. The loudspeaker 112 receives the analog control sound signal Yc and reproduces and emits the control sound Vc.

Figure 4:
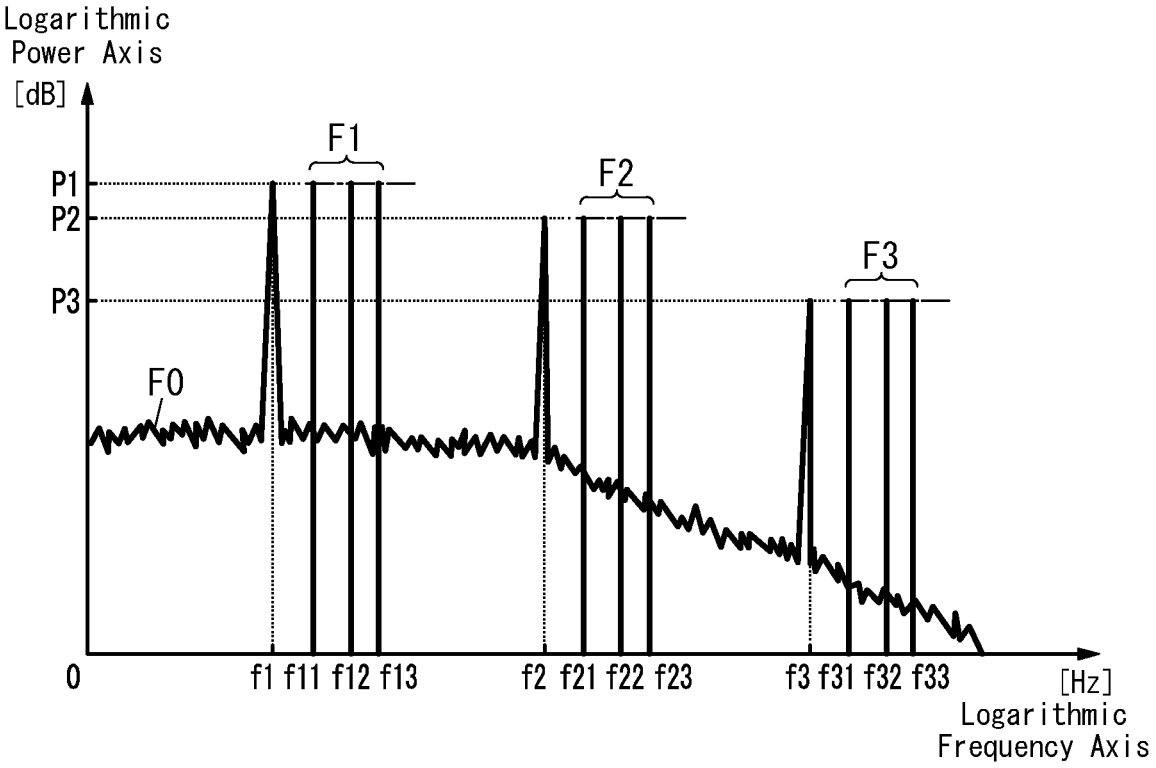
FIG. 4 is a graph showing a frequency distribution of an audible sound at a control point in the noise canceling system.

Therefore, the sound audible at the control point Q1 includes respective signal components with the noise frequencies f1, f2, and f3 and respective signal components with the additional frequencies f11, f12, f13, f21, f22, f23, f31, f32, and f33 (see FIG. 4).

In this case, combining the sound with the noise frequency f1 with respective sounds with the additional frequencies f11, f12, and f13, each having a high degree of consonance with respect to the sound with the noise frequency f1, reduces the unpleasantness caused by the noise frequency f1, thus making the composite sound pleasing to the user's ear. Likewise, combining the sound with the noise frequency f2 with respective sounds with the additional frequencies f21, f22, and f23, each having a high degree of consonance with respect to the sound with the noise frequency f2, reduces the unpleasantness caused by the noise frequency f2, thus making the composite sound pleasing to the user's ear. Furthermore, combining the sound with the noise frequency f3 with respective sounds with the additional frequencies f31, f32, and f33, each having a high degree of consonance with respect to the sound with the noise frequency f3, reduces the unpleasantness caused by the noise frequency f3, thus making the composite sound pleasing to the user's ear. This reduces the unpleasantness caused to the user by respective sounds with the noise frequencies f1, f2, and f3.

Furthermore, each single noise frequency f1 (or f2 or f3) is combined with a plurality of additional frequencies f11, f12, and f13 (or f21, f22, and f23, or f31, f32, and f33). This allows the components of the sound emitted as the control sound Vc with respective frequencies to form a chord, and therefore, sound pleasing to the user's ear.

In addition, the control sound Vc includes a sound represented by the canceling signal Ya(n) (i.e., a canceling sound). This allows the canceling sound included in the control sound Vc to actively cancel the noise Vn and thereby reduce the noise Vn at the control point Q1.

Note that the additional sound generating unit 138 does not have to use all of, but may also use one or two of, 5/4, 3/2, and 5/3 as the ratio of the additional frequency to the noise frequency. In that case, as signal component(s) with an additional frequency having a high degree of consonance with respect to the noise frequency f1, the additional sound generating unit 138 generates signal component(s) with one or two frequencies selected from the group consisting of the additional frequencies f11, f12, and f13. In addition, as signal component(s) with an additional frequency having a high degree of consonance with respect to the noise frequency f2, the additional sound generating unit 138 generates signal component(s) with one or two frequencies selected from the group consisting of the additional frequencies f21, f22, and f23. Furthermore, as signal component(s) with an additional frequency having a high degree of consonance with respect to the noise frequency f3, the additional sound generating unit 138 generates signal component(s) with one or two frequencies selected from the group consisting of the additional frequencies f31, f32, and f33.

Optionally, the additional sound generating unit 138 may also use, as the additional frequency, a frequency, of which the ratio to the noise frequency is not equal to 5/4, 3/2, or 5/3. Generally speaking, if the ratio of an additional frequency to a noise frequency is a ratio of integers (i.e., an integer/an integer), the degree of consonance of the additional frequency with respect to the noise frequency may be regarded as being high. Therefore, as long as at least the ratio of the additional frequency to the noise frequency is a ratio of integers, the unpleasantness caused to the user by a sound with the noise frequency is reducible.

Furthermore, according to harmony rules, for example, there are various combinations of additional frequencies with noise frequencies. Specifically, if the ratio of an additional frequency to the noise frequency is 3/2 (perfect fifth) or 4/3 (perfect fourth), then such intervals are called "perfect concords." On the other hand, if the ratio of an additional frequency to the noise frequency is 5/4 (major third), 6/5 (minor third), 5/3 (major sixth), or 8/5 (minor sixth), then such intervals are called "imperfect concords." Furthermore, if the ratio of an additional frequency to the noise frequency satisfies neither the perfect concords nor the imperfect concords, then such an interval is called a "dissonant interval." Generally speaking, if the ratio of the additional frequency to the noise frequency satisfies either the perfect concords or the imperfect concords, then the degree of consonance should be regarded as high. That is why the additional frequency to be combined with the noise frequency is suitably selected from the interval with the perfect concords and the interval with the imperfect concords. Also, although a chord is formed of two or more tones, the chord does not have to be the major sixth chord but may also be any other chord.

Nevertheless, the interval regarded as having a high degree of consonance may vary according to region, ethnic background, age, or any other factor, and therefore, the ratio of the additional frequency to the noise frequency may be set as appropriate based on region, ethnic background, age, or any other factor.

In addition, the additional sound generating unit 138 suitably defines the waveforms of respective signal components, having the additional frequencies f11, f12, and f13, the additional frequencies f21, f22, and f23, and the additional frequencies f31, f32, and f33 and included in the additional sound signal Yb(n), to be a sinusoidal waveform with the additional frequencies. This allows the additional sound generating unit 138 to generate a signal with the additional frequencies more easily.

Optionally, the additional sound generating unit 138 may define the waveform of the respective signal components having the additional frequencies and included in the additional sound signal Yb(n) to be a waveform in which a sinusoidal waveform with the additional frequencies and a high-order harmonic waveform with the additional frequencies are superposed one on top of the other. This allows an additional sound including a harmonic overtone of the additional frequencies to be emitted, thus further reducing the user's unpleasantness.

Figure 5:
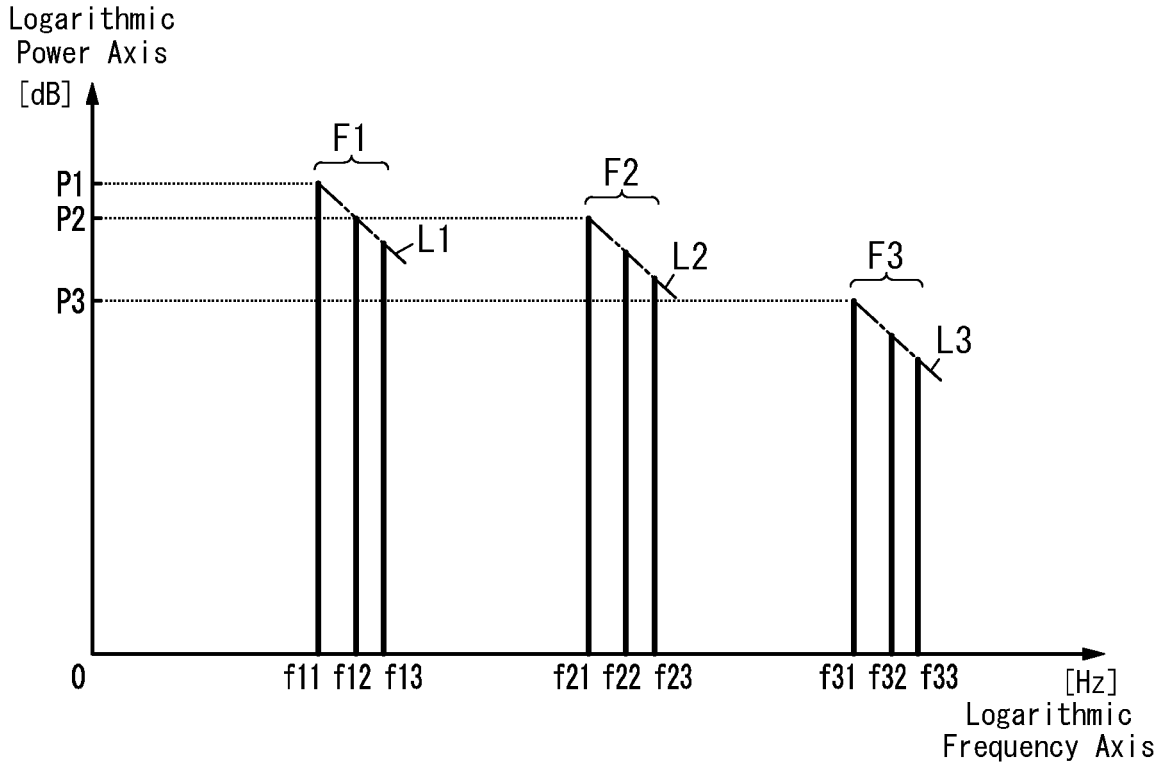
FIG. 5 is a graph showing another frequency distribution of the additional sound signal in the noise canceling system.

Optionally, the respective gradients of the lines L1, L2, and L3 shown in FIG. 3 do not have to be zero. For example, as shown in FIG. 5, if the gradient of the line L1 is negative, then the power of the signal component with the additional frequency f11 is greater than the power of the signal component with the additional frequency f12, and the power of the signal component with the additional frequency f12 is greater than the power of the signal component with the additional frequency f13. Likewise, if the gradient of the line L2 is negative, then the power of the signal component with the additional frequency f21 is greater than the power of the signal component with the additional frequency f22, and the power of the signal component with the additional frequency f22 is greater than the power of the signal component with the additional frequency f23. Furthermore, if the gradient of the line L3 is negative, then the power of the signal component with the additional frequency f31 is greater than the power of the signal component with the additional frequency f32, and the power of the signal component with the additional frequency f32 is greater than the power of the signal component with the additional frequency f33.

The human auditory system has such frequency characteristics that make their ears less sensitive to a low-frequency sound than to a high-frequency sound as represented by an equal loudness curve, for example. In FIG. 5, the power of each signal component with an additional frequency is corrected according to the frequency characteristics of the human auditory system, thus striking a pleasing balance between the sound with the noise frequency and a sound with an additional frequency. This further reduces the unpleasantness caused to the user by the sound with the noise frequency.

In addition, as the noise canceling effect achieved by the canceling sound included in the control sound Vc improves with a decline in the variation of the noise Vn or the variation in the noise propagation characteristic or with stabilization of the processing of updating the first filter coefficient W(n), for example, the power decreases at the noise frequency of the error signal E(n). When the power at the noise frequency decreases too much for the additional sound generating unit 138 to detect the noise frequency, the additional sound generating unit 138 stops performing the processing of generating signal components with an additional frequency corresponding to the noise frequency. Then, when the additional sound generating unit 138 is no longer able to detect any noise frequency, the additional sound generating unit 138 stops performing the processing of generating the additional sound signal Yb(n).

Figure 6:
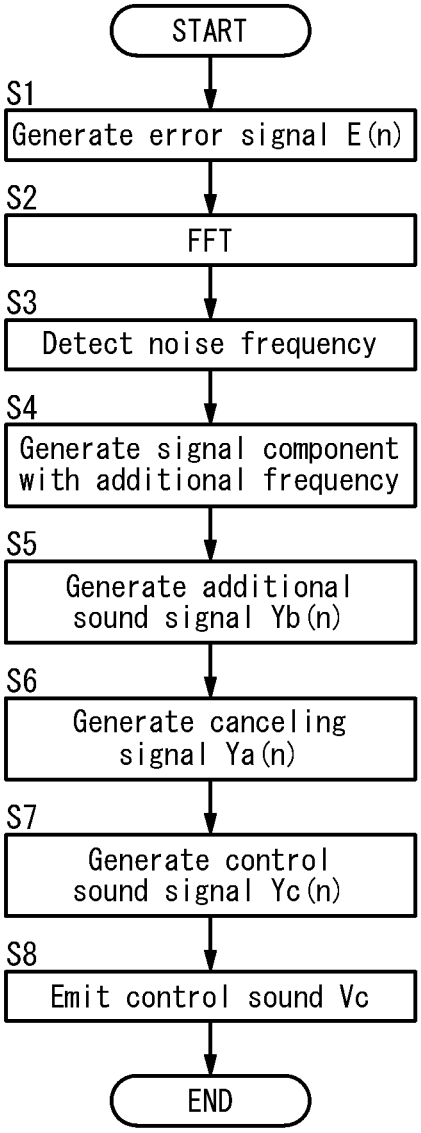
FIG. 6 is a flowchart showing a signal processing method to be performed by the noise canceling system.

A signal processing method is performed by the signal processor 12 described above as shown in the flowchart of FIG. 6.

First, the subtractor 133 generates an error signal E(n) (in Step S1). Next, the additional sound generating unit 138 transforms, by FFT, the error signal E(n) into a signal in a frequency domain (in Step S2), thereby detecting a noise frequency (in Step S3). Subsequently, the additional sound generating unit 138 generates a signal component (such as a sinusoidal wave component) with an additional frequency having a high degree of consonance with respect to the noise frequency (in Step S4) and outputs an additional sound signal Yb(n) including the signal component with the additional frequency (in Step S5). Then, the canceling signal generating unit 141 generates a canceling signal Ya(n) to cancel the noise Vn at the control point Q1 (in Step S6). Thereafter, the adder 139 adds the additional sound signal Yb(n) to the canceling signal Ya(n) and outputs the sum signal as a control sound signal Yc(n) (in Step S7). The digital control sound signal Yc(n) is converted by the D/A converter 122 into an analog control sound signal Yc. Finally, the loudspeaker 112 receives the control sound signal Yc and reproduces and emits a control sound Vc (in Step S8).

A signal processor 12 according to a first aspect of an exemplary embodiment includes an additional sound generating unit 138, a canceling signal generating unit 141, and an emission unit 142. The additional sound generating unit 138 detects, as a noise frequency f1, f2, f3, a frequency of a noise Vn produced from a noise source 8 and generates an additional sound signal Yb(n) including signal components with additional frequencies f11, f12, f13, f21, f22, f23, f31, f32, f33 different from the noise frequency f1, f2, f3. The canceling signal generating unit 141 generates a canceling signal Ya(n) that cancels the noise Vn at a control point Q1 that the noise Vn and a control sound Vc emitted from a loudspeaker 112 (sound emitter) reach. The emission unit 142 outputs a control sound signal Yc(n), generated by adding the additional sound signal Yb(n) to the canceling signal Ya(n), to the loudspeaker 112 and makes the loudspeaker 112 emit the control sound Vc.

Specifically, the sound audible at the control point Q1 includes signal components with the noise frequencies f1, f2, f3 and the additional frequencies f11, f12, f13, f21, f22, f23, f31, f32, f33. In addition, the sound with the noise frequency f1 is combined with respective sounds with the additional frequencies f11, f12, f13 having a high degree of consonance. The sound with the noise frequency f2 is combined with respective sounds with the additional frequencies f21, f22, f23 having a high degree of consonance. The sound with the noise frequency f3 is combined with respective sounds with the additional frequencies f31, f32, f33 having a high degree of consonance. Furthermore, the canceling sound included in the control sound Vc reduces the noise Vn transmitted to the control point Q1. This allows the signal processor 12 to actively reduce the noise Vn and decrease the unpleasantness caused to the user by a residual component of the noise Vn (i.e., residual noise component) that has not been canceled.

In a signal processor 12 according to a second aspect of the exemplary embodiment, which may be implemented in conjunction with the first aspect, the noise frequency f1, f2, f3 is suitably a frequency of the noise Vn at the control point Q1.

This allows the signal processor 12 to actively reduce the noise Vn and decrease the unpleasantness caused to the user by a residual component of the noise Vn (i.e., residual noise component) that has not been canceled.

In a signal processor 12 according to a third aspect of the exemplary embodiment, which may be implemented in conjunction with the first or second aspect, a ratio of the additional frequency f11, f12, f13 (or f21, f22, f23 or f31, f32, f33) to the noise frequency f1 (or f2 or f3) is suitably a ratio of integers.

This allows the signal processor 12 to decrease the unpleasantness caused to the user by the sound with the noise frequency.

In a signal processor 12 according to a fourth aspect of the exemplary embodiment, which may be implemented in conjunction with the third aspect, the ratio of the additional frequency f11, f12, f13 (or f21, f22, f23 or f31, f32, f33) to the noise frequency f1 (or f2 or f3) is suitably at least one of 5/4, 3/2, or 5/3.

Specifically, the signal processor 12 uses, as the additional frequency, a frequency that forms a chord when combined with the noise frequency. This allows the sounds emitted as the control sounds Vc with a plurality of frequencies to form a chord, which sounds pleasing to the user's ear.

In a signal processor 12 according to a fifth aspect of the exemplary embodiment, which may be implemented in conjunction with any one of the first to third aspects, the additional sound generating unit 138 suitably generates the additional sound signal Yb(n) including respective signal components with a plurality of the additional frequencies f11, f12, f13 (or f21, f22, f23 or f31, f32, f33) corresponding to the noise frequency f1 (or f2 or f3).

Specifically, the signal processor 12 combines the plurality of the additional frequencies f11, f12, f13 (or f21, f22, f23 or f31, f32, f33) with the noise frequency f1 (or f2 or f3). This allows the sounds emitted as the control sounds Vc with a plurality of frequencies to form a chord, which sounds pleasing to the user's ear.

In a signal processor 12 according to a sixth aspect of the exemplary embodiment, which may be implemented in conjunction with the fifth aspect, respective powers at the plurality of additional frequencies f11, f12, f13 (or f21, f22, f23 or f31, f32, f33) of the additional sound signal Yb(n) suitably have values on a virtual line L1 (or L2 or L3) that has a constant gradient with respect to a frequency represented by a logarithmic axis.

That is to say, this allows the signal processor 12 to correct the powers of the signal components with the additional frequencies according to the frequency characteristic of human auditory system.

In a signal processor 12 according to a seventh aspect of the exemplary embodiment, which may be implemented in conjunction with the sixth aspect, the gradient is suitably equal to zero.

This allows the signal processor 12 to simplify the signal processing to be performed by the additional sound generating unit 138.

In a signal processor 12 according to an eighth aspect of the exemplary embodiment, which may be implemented in conjunction with any one of the first to seventh aspects, the signal component with the additional frequency f11, f12, f13, f21, f22, f23, f31, f32, f33 suitably has a sinusoidal waveform.

This allows the signal processor 12 to generate a signal with the additional frequency easily.

In a signal processor 12 according to a ninth aspect of the exemplary embodiment, which may be implemented in conjunction with any one of the first to eighth aspects, the additional sound generating unit 138 suitably detects, as the noise frequency f1, f2, f3, a frequency at which power of the noise Vn picked up at the control point Q1 reaches a local maximum value.

This allows the signal processor 12 to detect the noise frequency f1, f2, f3 easily.

In a signal processor 12 according to a tenth aspect of the exemplary embodiment, which may be implemented in conjunction with any one of the first to ninth aspects, the additional sound generating unit 138 suitably detects, as the noise frequency f1, f2, f3, a frequency of a period noise out of the noise Vn.

Thus, the signal processor 12 is able to decrease the unpleasantness caused to the user by a periodic noise when installed around the noise source 8 that produces the periodic noise.

A signal processor 12 according to an eleventh aspect of the exemplary embodiment, which may be implemented in conjunction with any one of the first to tenth aspects, suitably further includes a subtractor 133. The subtractor 133 generates an error signal E(n) by removing a signal component of the additional sound signal Yb(n) from a signal representing the sound picked up at the control point Q1. Then, the additional sound generating unit 138 detects the noise frequency f1, f2, f3 based on the error signal E(n).

Specifically, the signal processor 12 is able to generate an error signal E(n) by removing a sneak of the additional sound from the control sound Vc. This allows the signal processor 12 to detect the noise frequency f1, f2, f3 based on the error signal E(n) from which the harmful effect of the additional sound has been removed, thus improving the accuracy of detection of the noise frequency f1, f2, f3.

In a signal processor 12 according to a twelfth aspect of the exemplary embodiment, which may be implemented in conjunction with any one of the first to eleventh aspects, the canceling signal generating unit 141 suitably includes a noise control filter 137, a correction filter 135, and a coefficient updating unit 136. A first filter coefficient W(n) is set for the noise control filter 137. The noise control filter 137 receives a noise signal X(n) that is a signal representing the noise Vn picked up by a microphone 111 (sound collector) at the control point Q1. Then, the noise control filter 137 performs arithmetic processing based on the noise signal X(n) and the first filter coefficient W(n), thereby generating the canceling signal Ya(n). A sound wave transmission characteristic C_hat from the loudspeaker 112 to the microphone 111 is set as a second filter coefficient for the correction filter 135. The correction filter 135 generates a reference signal R(n) by performing arithmetic processing based on the noise signal X(n) and the transmission characteristic C_hat (second filter coefficient). The coefficient updating unit 136 obtains the first filter coefficient W(n) based on the reference signal R(n) and updates the first filter coefficient W(n) of the noise control filter 137.

That is to say, the noise control filter 137 is an adaptive filter, and is able to make the canceling signal Ya(n) follow any variation in the noise produced from the noise source 8 or any variation in the noise propagation characteristic thereof. This allows the signal processor 12 to have improved noise Vn canceling capability.

A noise canceling system 1 according to a thirteenth aspect of the exemplary embodiment includes: the signal processor 12 according to any one of the first to twelfth aspects; a microphone 111 (sound collector); and a loudspeaker 112 (sound emitter). The microphone 111 converts a sound picked up at the control point Q1 into a picked up signal, and outputs the picked up signal to the signal processor 12. The loudspeaker 112 receives the control sound signal Yc(n) and emits the control sound Vc.

This allows the noise canceling system 1, as well as the signal processor 12 described above, to actively reduce the noise Vn and decrease the unpleasantness caused to the user by a residual component of the noise Vn (i.e., residual noise component) that has not been canceled.

A signal processing method according to a fourteenth aspect of the exemplary embodiment includes the following steps:

Steps S1-S5: detecting, as a noise frequency f1, f2, f3, a frequency of a noise Vn produced from a noise source 8 and generating an additional sound signal Yb(n) including a signal component with an additional frequency f11, f12, f13, f21, f22, f23, f31, f32, f33 different from the noise frequency f1, f2, f3.

Step S6: generating a canceling signal Ya(n) that cancels the noise Vn at a control point Q1 that the noise Vn and a control sound Vc emitted from a loudspeaker 112 (sound emitter) reach.

Steps S7 and S8: outputting a control sound signal Yc(n), generated by adding the additional sound signal Yb(n) to the canceling signal Ya(n), to the loudspeaker 112 to make the loudspeaker 112 emit the control sound Vc.

This allows the signal processing method, as well as the signal processor 12 described above, to actively reduce the noise Vn and decrease the unpleasantness caused to the user by a residual component of the noise Vn (i.e., residual noise component) that has not been canceled.

A program according to a fifteenth aspect of the exemplary embodiment is designed to make a computer system execute the signal processing method according to the fourteenth aspect.

This allows the program, as well as the signal processor 12 described above, to actively reduce the noise Vn and decrease the unpleasantness caused to the user by a residual component of the noise Vn (i.e., residual noise component) that has not been canceled.

Note that embodiments described above are only examples of the present disclosure and should not be construed as limiting. Rather, those embodiments may be readily modified in various manners, depending on a design choice or any other factor, without departing from a true spirit and scope of the present disclosure.

REFERENCE SIGNS LIST

1 Noise Canceling System
11 Sound Collector-Emitter
12 Signal Processor
111 Microphone (Sound Collector)
112 Loudspeaker (Sound Emitter)

133 Subtractor
135 Correction Filter
136 Coefficient Updating Unit
137 Noise Control Filter
138 Additional Sound Generating Unit
141 Canceling Signal Generating Unit
142 Emission unit
8 Noise Source
Vn Noise
Vc Control Sound
Q1 Control Point
f1, f2, f3 Noise Frequency
f11, f12, f13, f21, f22, f23, f31, f32, f33 Additional Frequency
Ya(n) Canceling Signal
Yb(n) Additional Sound Signal
Yc(n) Control Sound Signal
E(n) Error Signal
X(n) Noise Signal
R(n) Reference Signal
W(n) First Filter Coefficient
C_hat Transmission Characteristic (Second Filter Coefficient)
L1, L2, L3 Line

The invention claimed is:

1. A signal processor comprising:

an additional sound generating unit configured to detect, as a noise frequency, a frequency of a noise produced from a noise source and to generate an additional sound signal including a signal component with an additional frequency different from the noise frequency;

a canceling signal generating unit configured to generate a canceling signal for canceling the noise at a control point that the noise and a control sound emitted from a sound emitter reach based on the noise collected at the control point; and an emission unit configured to output a control sound signal, generated by adding the additional sound signal to the canceling signal, to the sound emitter and to make the sound emitter emit the control sound, a ratio of the additional frequency to the noise frequency being a ratio of integers.

2. The signal processor of claim 1, wherein the noise frequency is a frequency of the noise at the control point.

3. The signal processor of claim 1, wherein the ratio of the additional frequency to the noise frequency is at least one of 5/4, 3/2, or 5/3.

4. The signal processor of claim 1, wherein the additional sound generating unit is configured to generate the additional sound signal including respective signal components with a plurality of the additional frequencies corresponding to the noise frequency.

5. The signal processor of claim 4, wherein respective powers of the additional sound signal at the plurality of additional frequencies have values on a virtual line that has a constant gradient with respect to a frequency represented by a logarithmic axis.

6. The signal processor of claim 5, wherein the gradient is equal to zero.

7. The signal processor of claim 1, wherein the signal component with the additional frequency has a sinusoidal waveform.

8. The signal processor of claim 1, wherein the additional sound generating unit is configured to detect, as the noise frequency, a frequency at which power of the noise picked up at the control point reaches a local maximum value.

9. The signal processor of claim 1, wherein the additional sound generating unit is configured to detect, as the noise frequency, a frequency of a periodic noise out of the noise.

10. The signal processor of claim 1, further comprising a subtractor configured to generate an error signal by removing a signal component of the additional sound signal from a signal representing the sound picked up at the control point, wherein the additional sound generating unit is configured to detect the noise frequency based on the error signal.

11. The signal processor claim 1, wherein the canceling signal generating unit includes:

a noise control filter, for which a first filter coefficient is set and which is configured to generate the canceling signal by receiving a noise signal that is a signal representing the noise picked up by a sound collector at the control point and by performing arithmetic processing based on the noise signal and the first filter coefficient;

a correction filter, for which a sound wave transmission characteristic from the sound emitter to the sound collector is set as a second filter coefficient, and which is configured to generate a reference signal by performing arithmetic processing based on the noise signal and the second filter coefficient; and a coefficient updating unit configured to obtain the first filter coefficient based on the reference signal and update the first filter coefficient of the noise control filter.

12. A noise canceling system comprising:

the signal processor of claim 1;

a sound collector configured to convert a sound picked up at the control point into a picked up signal, and output the picked up signal to the signal processor; and a sound emitter configured to receive the control sound signal and emit the control sound.

13. A signal processing method comprising:

detecting, as a noise frequency, a frequency of a noise produced from a noise source to generate an additional sound signal including a signal component with an additional frequency different from the noise frequency;

generating a canceling signal for canceling the noise at a control point that the noise and a control sound emitted from a sound emitter reach based on the noise collected at the control point; and outputting a control sound signal, generated by adding the additional sound signal to the canceling signal, to the sound emitter to make the sound emitter emit the control sound; and setting a ratio of the additional frequency to the noise frequency at a ratio of integers.

14. A non-transitory storage medium storing a program designed to make a computer system execute the signal processing method of claim 13.

* * * * *